US009592622B2

(12) United States Patent
Bagley

(10) Patent No.: US 9,592,622 B2
(45) Date of Patent: Mar. 14, 2017

(54) CIRCLE CUTTER FOR FABRIC

(71) Applicant: Jim Matthews Bagley, West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 106 days.

(21) Appl. No.: 14/062,970

(22) Filed: Oct. 25, 2013

(65) Prior Publication Data

US 2015/0113813 A1 Apr. 30, 2015

(51) Int. Cl.

| | |
|---|---|
| ***B26F 1/38*** | (2006.01) |
| ***B26D 1/16*** | (2006.01) |
| ***B26D 7/00*** | (2006.01) |
| ***B26D 7/01*** | (2006.01) |
| ***B26D 7/26*** | (2006.01) |

(52) U.S. Cl.

CPC ..... *B26F 1/3846* (2013.01); *B26D 1/165* (2013.01); *B26D 7/0006* (2013.01); *B26D 7/01* (2013.01); *B26D 7/2621* (2013.01); *B26D 7/2635* (2013.01)

(58) Field of Classification Search

CPC ..... B26F 1/3846; B26D 1/141

USPC ..... 30/310; 33/27.03, 27.031, 27.032, 27.02

See application file for complete search history.

(56) References Cited

U.S. PATENT DOCUMENTS

| | | | | |
|---|---|---|---|---|
| 1,423,828 | A | 7/1922 | Butterfield | |
| 2,943,392 | A * | 7/1960 | Attridge | 30/310 |
| 3,491,448 | A * | 1/1970 | Quinton | B43L 7/005 33/27.01 |
| 3,621,574 | A | 11/1971 | Yanke | |
| 4,593,467 | A | 6/1986 | Safar | |
| 4,878,409 | A * | 11/1989 | Carithers, Jr. | B26F 1/3846 33/27.01 |
| 5,014,436 | A * | 5/1991 | Kozyrski et al. | 33/27.03 |
| 5,050,309 | A * | 9/1991 | Wang | 33/449 |
| 5,596,809 | A * | 1/1997 | Beard | 30/310 |
| 5,860,217 | A | 1/1999 | Braun | |
| 5,895,183 | A * | 4/1999 | McDaniel et al. | 409/179 |
| 6,286,216 | B1 * | 9/2001 | Braun | 30/310 |
| 6,889,440 | B2 * | 5/2005 | Okada | 33/27.031 |
| 8,793,884 | B1 * | 8/2014 | Chen | 30/310 |

(Continued)

FOREIGN PATENT DOCUMENTS

| | | |
|---|---|---|
| CA | 2250561 A1 | 7/1999 |
| DE | 202008002455 U | 4/2009 |

(Continued)

*Primary Examiner* — Sean Michalski
*Assistant Examiner* — Fernando Ayala
(74) *Attorney, Agent, or Firm* — J. David Nelson

(57) ABSTRACT

A fabric circle cutter having a cutter base, a pivot pin assembly, and a blade assembly. The cutter base has a flat, smooth bottom surface with a turned up edge. The cutter base also has a raised base section which has a pivot point slide slot. The pivot pin assembly is slidably mounted on the raised base section and slidably mated with the pivot point slide slot which provides for selective positioning of the pivot pin assembly. The blade assembly has a rotary blade with a blade axis which is aligned approximately horizontally with and approximately parallel to the center line of the pivot point slide.

7 Claims, 10 Drawing Sheets

(56) References Cited

U.S. PATENT DOCUMENTS

| | | | | |
|---|---|---|---|---|
| 2009/0126546 | A1* | 5/2009 | Chiang | B26D 1/185 83/614 |
| 2009/0235798 | A1* | 9/2009 | Loibl | B26D 1/185 83/485 |
| 2011/0192265 | A1* | 8/2011 | Yoder | 83/522.19 |
| 2011/0302792 | A1* | 12/2011 | Exley et al. | 30/310 |
| 2013/0319915 | A1* | 12/2013 | Gellibolian | C02F 1/002 210/87 |

FOREIGN PATENT DOCUMENTS

| | | | |
|---|---|---|---|
| WO | WO 2010048643 | A2 | 4/2010 |
| WO | WO 2011156726 | A1 | 12/2011 |

* cited by examiner

CIRCLE CUTTER FOR FABRIC

BACKGROUND OF THE INVENTION

This invention is in the field of fabric cutting devices and in particular in the field of devices for cutting circles in fabric.

Devices and methods for cutting a circular swatch of fabric from a larger piece of fabric are useful for quilting, embroidery and other sewing activities. Methods and devices known in the art have provided this capacity with varying degrees of success. There are two primary methods relied upon widely by persons engaged in quilting, embroidery or other sewing activities.

For the first method, a circular template made from a rigid material is used as a guide. The template holds down the fabric and a rotary cutter, or other fabric cutter is run along the edge of the template to cut out a circular swatch of fabric matching the shape and size of the circular template. The inherent limitation with using a circular template such as this, is that it provides the user the ability to cut only one size of circle, and the circle having a radius equal to the radius of the circular template. Further, the accuracy of the cut is reliant on the user's ability to keep the blade of the cutter firmly against the template as the fabric is cut. The user may rely on having circular templates of various radii. However, each such circular template will be limited for use in cutting a circular swatch that matches its particular radius.

For the second method, a circle cutting device is used which has a cutter arm with a short sharp point that serves as a center axis, and a rotary blade that adjusts in and out on the arm, or which has an adjustable arm that has the blade affixed to the end which slides in and out, providing a range of different size circles that can be cut out limited only by the length of the arm. This type of tool has two touch points on the fabric, the center axis pin and the blade. The fabric can easily be wrinkled as the blade rotates around its center axis.

An objective of the present invention is to provide a fabric circle cutter which has an adjustable cutting radius, thereby providing for the user to select any radius between the minimum and maximum radius of the fabric circle cutter.

A further objective of the present invention is to provide a fabric circle cutter that has a center pivot point and a rotary blade and that provides for smoothing and holding the fabric down around the center pivot point, around the rotary blade, and in the area between the center pivot point and the rotary blade, thereby preventing or minimizing wrinkling, over stretching, or other dimensional distortion of the fabric as it is cut.

A further objective the present invention is to provide a fabric circle cutter that provides for a retraction of the center pivot pin and the cutter blade when a cut is not being made, thereby increasing safety to the user.

SUMMARY OF THE INVENTION

A preferred embodiment of the fabric circle cutter of the present invention is comprised of a cutter base, a pivot pin assembly, and a blade assembly. The cutter base has a flat, smooth bottom surface with a turned up edge. The cutter base also has a raised base section which has a pivot point slide slot providing for a selective positioning of the pivot pin assembly. The pivot pin assembly is slidably mounted on the raised base section and slidably mated with the pivot point slide slot. The pivot pin assembly may be re-positioned in the pivot point slide slot by loosening the pivot assembly collar, sliding the pivot pin assembly along the pivot point slide slot to the desired position, and re-tightening the pivot assembly collar.

The blade assembly may be placed in a blade assembly closed configuration where it is ready to be used by the user for cutting a circular fabric swatch from a piece of fabric, or in a blade assembly open configuration where the blade insert, which contains the rotary blade and the blade retaining structure which secures the rotary blade to the blade assembly, may be removed. The blade insert may also be installed in the blade assembly while the blade assembly is in the blade assembly open configuration. With the blade assembly in the blade assembly open configuration, the blade cover may also be removed, to ready the fabric circle cutter for a cutting operation, or reinstalled to the blade guarded cover position for the safe stowing of the fabric circle cutter.

The pivot pin assembly may be placed in a pin up configuration or a pin down configuration. In the pin up configuration, the pivot pin does not extend below the cutter base bottom surface and thus does not engage the fabric layer. The pivot point slide anchor assembly secures the pivot pin assembly to the raised base section and maintains the proper positioning of the pin rod in the pivot point slide slot. A pivot rod spring maintains the pivot pin assembly in the pivot assembly pin up configuration, and the pivot rod and the pivot pin in the pivot pin up position. The pivot rod spring further provides, as a pivot assembly downward force is exerted on the pivot pin assembly top by a first hand of the user, for the pivot pin assembly to be lowered to the pivot assembly pin down configuration, and for the pivot rod and the pivot pin to be lowered to the pivot pin down position, thereby causing the pivot pin to engage the fabric layer. When the pivot assembly downward force exerted by the first hand of user is released, the pivot rod spring causes the pivot pin assembly to return to the pivot assembly pin up configuration and the pivot rod and the pivot pin to return to the pivot pin up position.

In the blade assembly non-engaged configuration, the blade spring arm causes the rotary blade to remain above the cutter base bottom surface, and, therefore, in this position, the rotary blade does not engage the fabric layer. A blade assembly downward force applied by the second hand of the user on the blade assembly top of the blade assembly causes the blade assembly to experience blade assembly downward movement. This causes the rotary blade to go from a blade non-engaged position to the blade engaged position where it has engaged and penetrated through the fabric layer.

The rotary blade is now in position for the fabric circle cutter to be operated to cut a circular pattern in the fabric layer. The pivot pin assembly is in the pin down configuration and the blade assembly is in the blade down configuration. The pivot pin is thus engaged in the fabric layer and the rotary blade is fully engaged and fully penetrated into the fabric layer.

For a preferred method of using the fabric circle cutter to cut a circular swatch from the fabric layer, the pivot pin assembly is in the pin down configuration due to a pivot assembly downward force exerted on the pivot assembly top by the first hand of the user, and the blade assembly in the blade down configuration due to a blade assembly downward force exerted on the blade assembly top by the second hand of the user. Thus, the rotary blade, can be clockwise rotated or counter-clockwise rotated around the pivot axis of the pivot pin, thereby making a circular cut. A turned up cutter base edge and a flat, smooth cutter base bottom surface, provide for the fabric to be retained in an unwrinkled and slightly tensioned condition as the rotary blade cuts the circular swatch from the fabric layer, the circular swatch having a radius equal to the cut radius selected by the user.

For preferred embodiments of the fabric circle cutter, radius measurement scales may be etched, painted or otherwise marked on one or both of the cutter base sides, which provides for direct and accurate measurement and setting of the cut radius using only the fabric circle cutter itself. The cutter base may be constructed of transparent material, and the raised base section wall may be convex on either or both sides, causing the raised base section wall to provide magnification of the view of the user of the fabric beneath the raised base section. This will aid the user to see and work with markings on the fabric beneath the raised base section, and to observe whether there are wrinkles in the fabric between the first base edge and the second base edge of the cutter base.

DETAILED DESCRIPTION OF PREFERRED EMBODIMENTS

Figure 1:
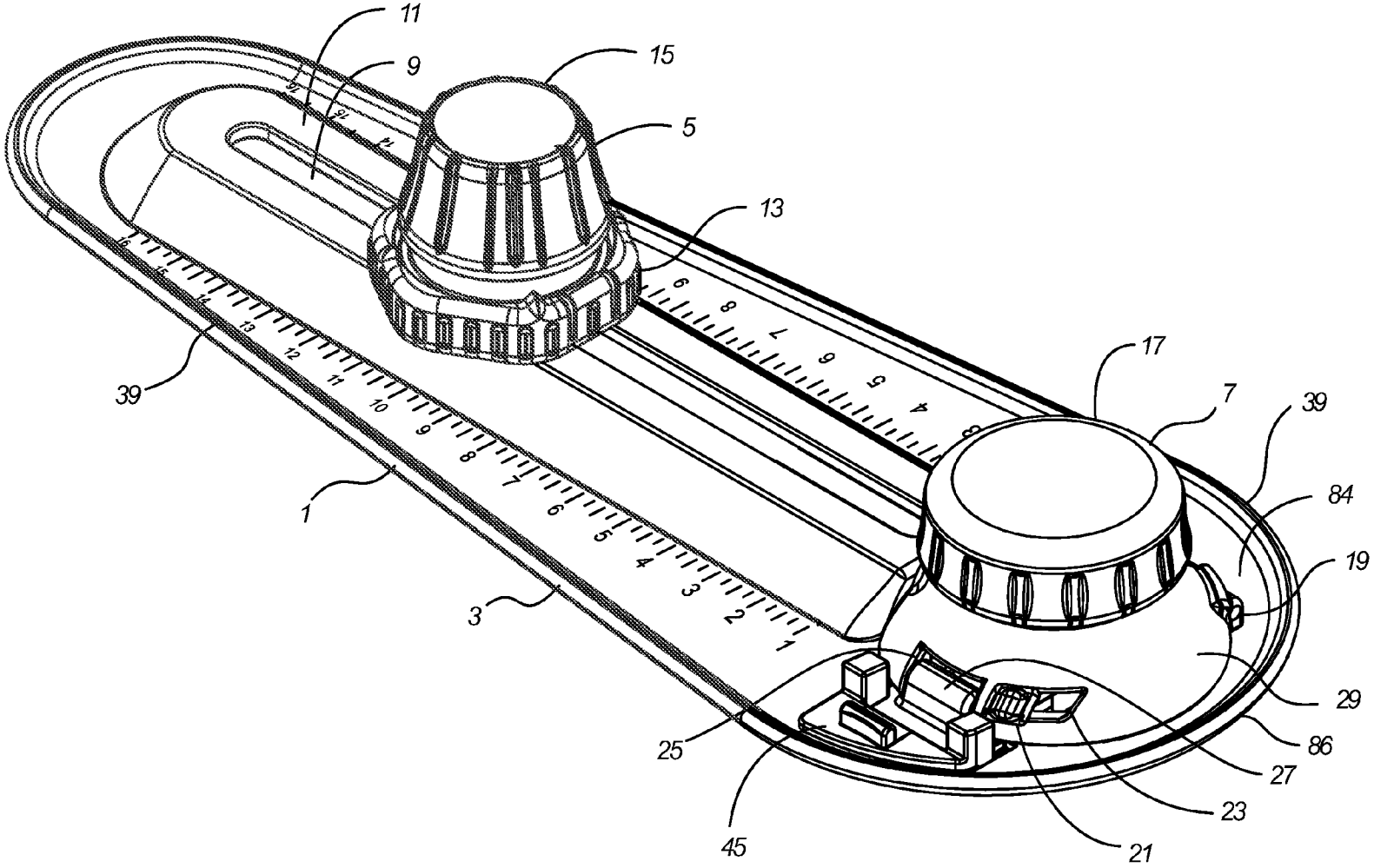
FIG. 1 is a top perspective view of a preferred embodiment of a fabric circle cutter of the present invention with the blade assembly in a blade assembly closed configuration.
Figure 7:
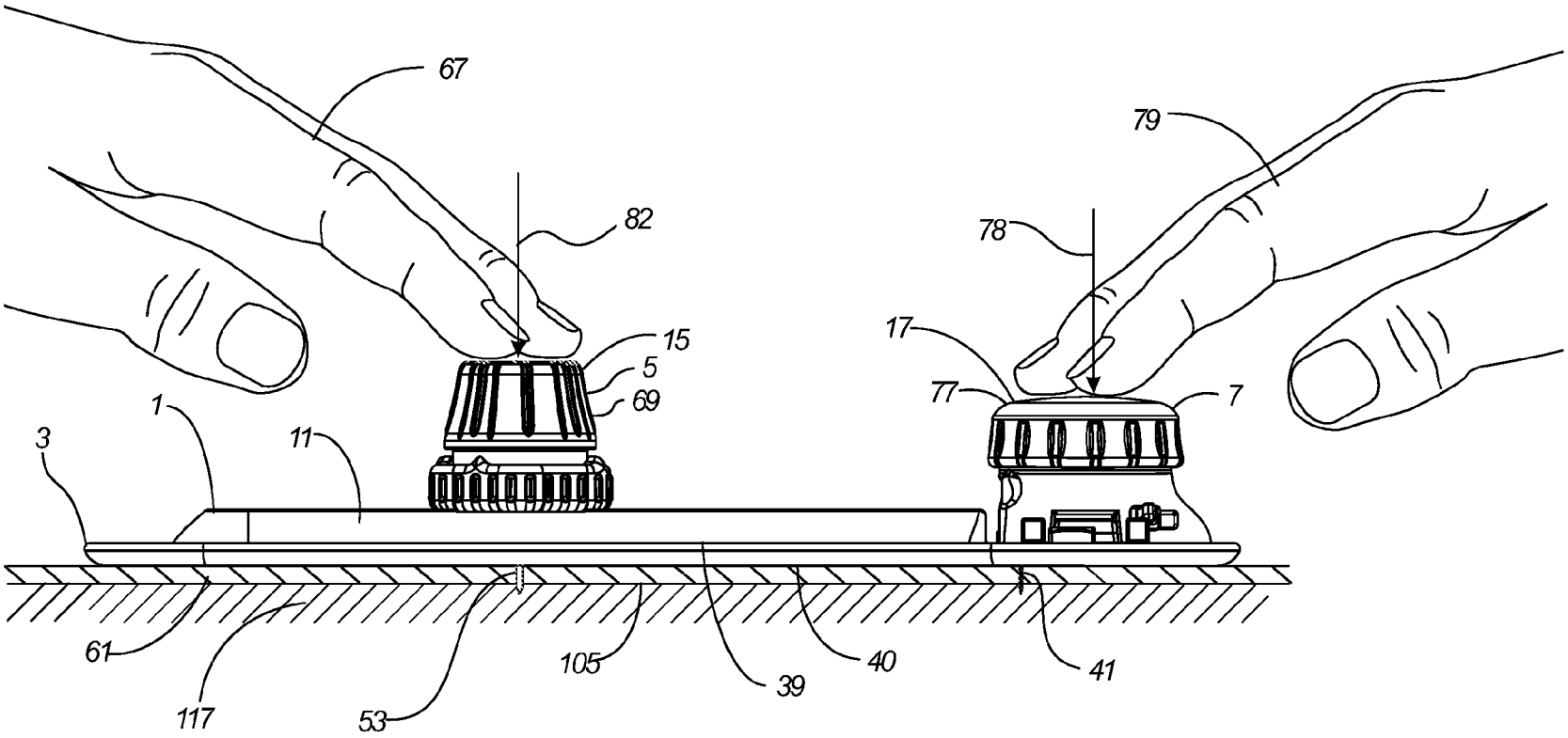
FIG. 7 is a vertical side view of a preferred embodiment of a fabric circle cutter of the present invention with the pivot pin in a pin down configuration and the rotary blade in a pin up configuration.
Figure 8:
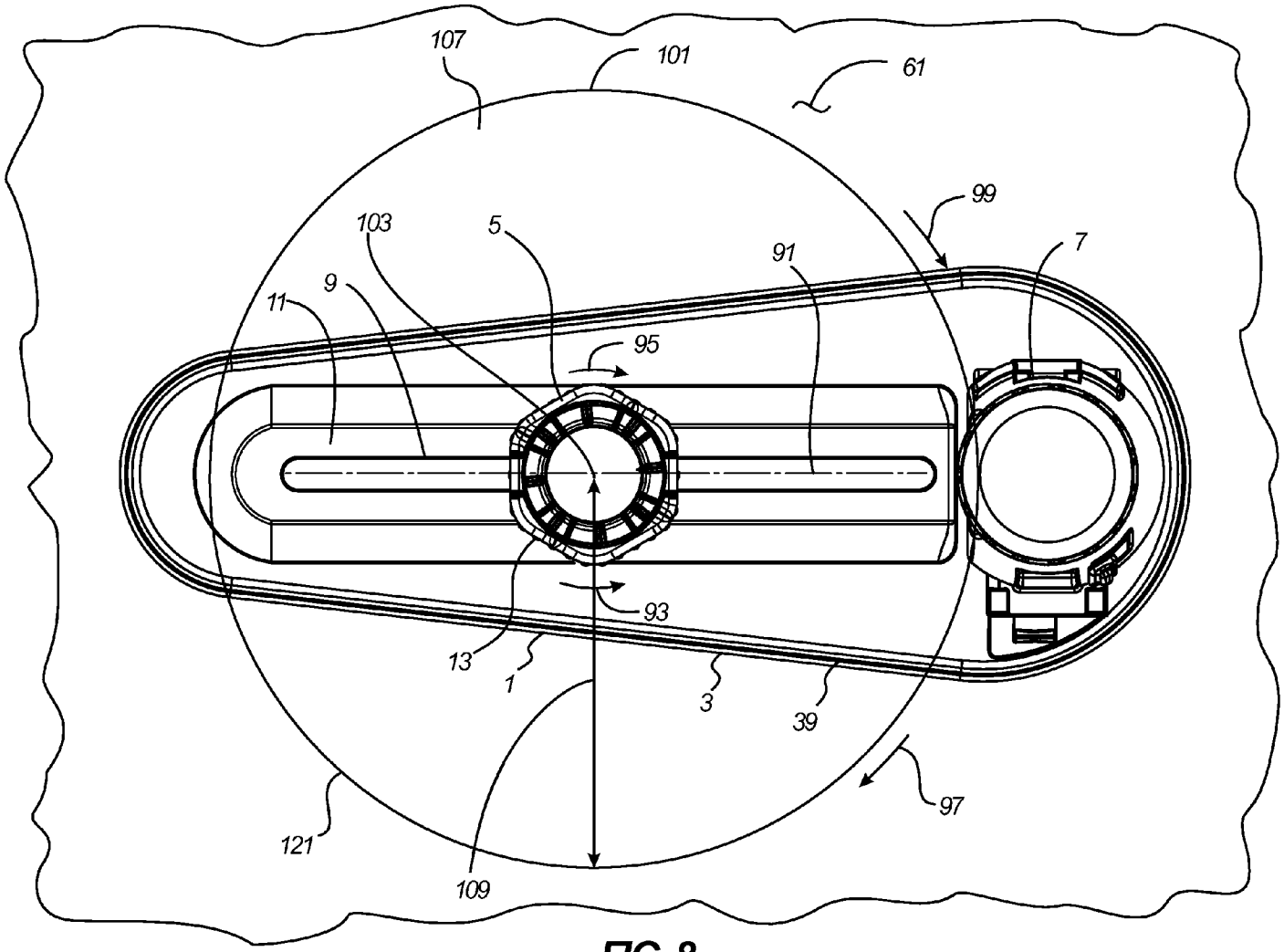
FIG. 8 is a plan view of a preferred embodiment of a fabric circle cutter of the present invention engaged in a cutting operation.

Referring first to FIG. 1 a top perspective view of a preferred embodiment of a fabric circle cutter 1 of the present invention is shown. This preferred embodiment of the fabric circle cutter 1 is comprised of a cutter base 3, a pivot pin assembly 5 and a blade assembly 7. Referring also to FIG. 7 the cutter base 3 may have a flat smooth bottom surface 40 with a turned up edge 39. The cutter base 3 for the embodiment shown in FIG. 1 also has a raised base section 11 which has a pivot point slide slot 9 providing for a selective positioning of the pivot pin assembly 5. The pivot pin assembly 5 is slidably mounted on the raised base section 11 and slidably mated with the pivot point slide slot 9. The pivot pin assembly 5 may be re-positioned in the pivot point slide slot 9 by loosening the pivot assembly collar 13, sliding the pivot pin assembly 5 along the pivot point slide slot 9 to the desired position, and re-tightening the pivot assembly collar 13. For the preferred embodiment shown, the pivot assembly collar 13 may be loosened from the cutter base 3 by rotating the pivot assembly collar 13 in collar loosening direction 93 and tightened by rotating the pivot assembly collar 13 in the collar tightening direction 95 as shown in FIG. 8.

Figure 2:
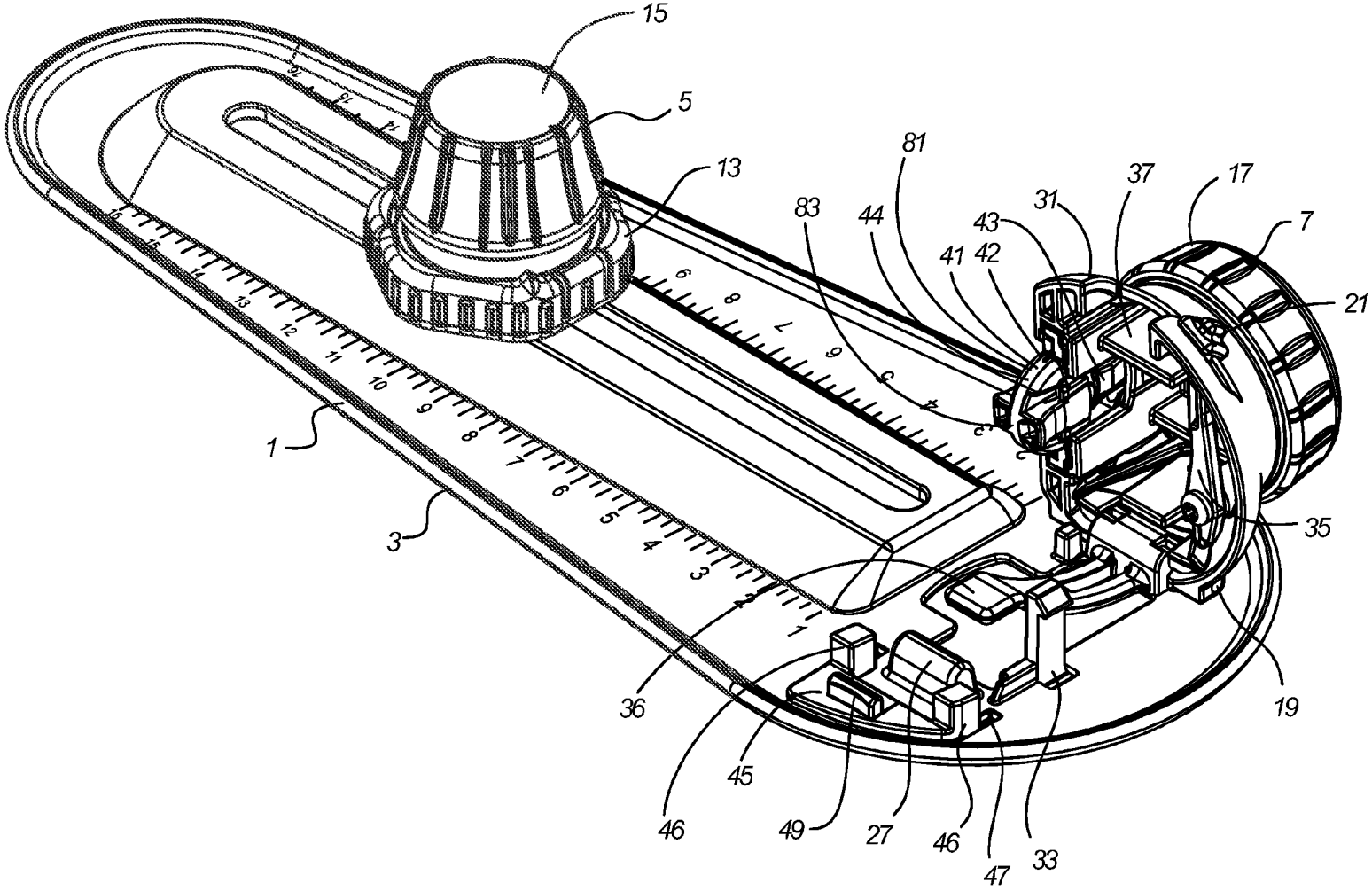
FIG. 2 is a top perspective view of a preferred embodiment of a fabric circle cutter of the present invention with the blade assembly in a blade assembly open configuration.
Figure 9:
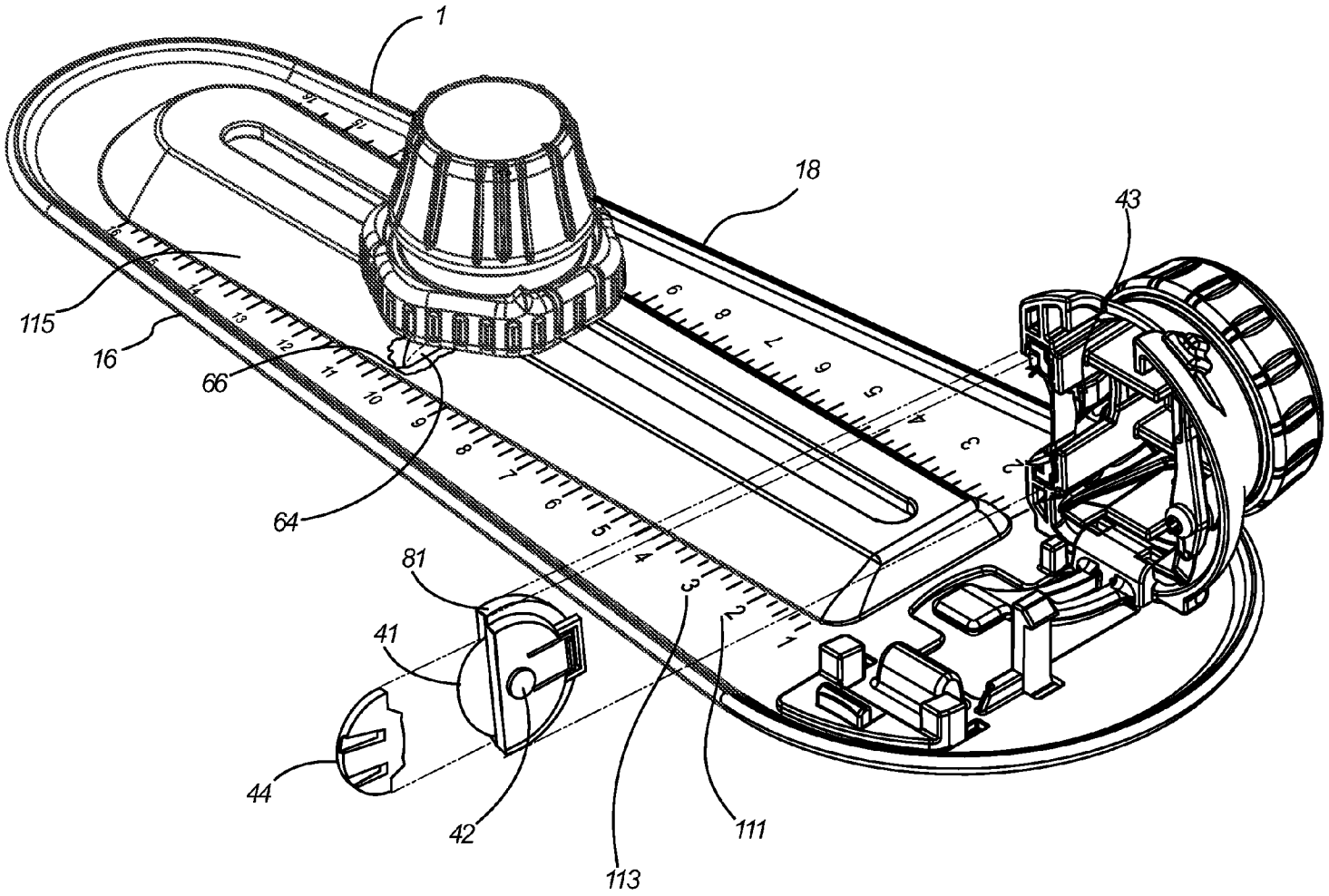
FIG. 9 is a top perspective view of a preferred embodiment of a fabric circle cutter of the present invention, the blade assembly being in an open configuration with a blade insert and blade cover shown in an exploded view, and the cutter base having radius measuring scales inscribed on the top of the cutter base.
Figure 10:
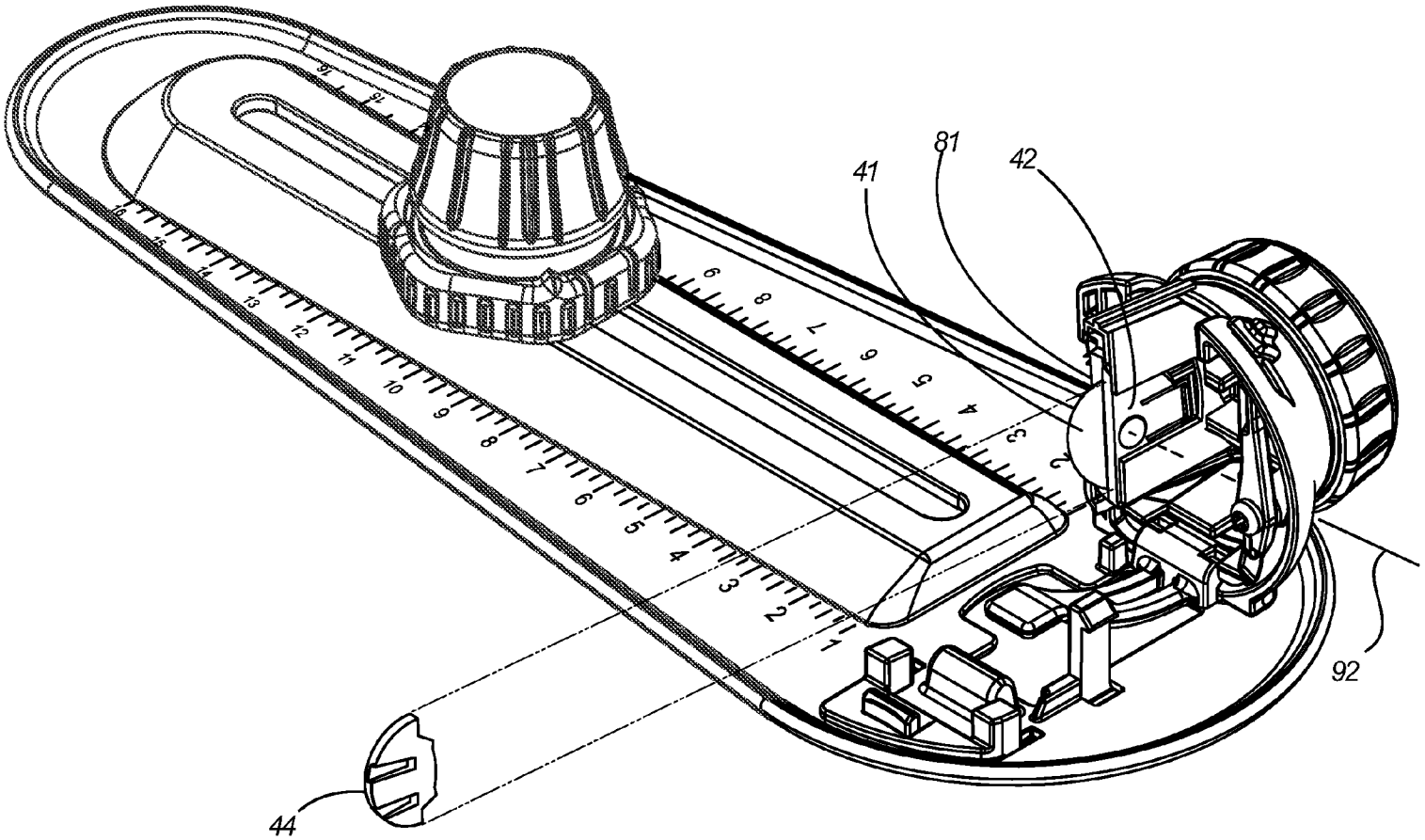
FIG. 10 is a top perspective view of a preferred embodiment of a fabric circle cutter of the present invention, the blade assembly being in an open configuration with a blade cover shown in an exploded view.

The blade assembly 7 is shown in FIG. 1 in a blade assembly closed configuration 29 where it is ready to be used by the user for cutting a circular fabric swatch from a piece of fabric. For the preferred embodiment shown, the blade assembly 7 is mounted on the base top 84 of the cutter base 3 proximal to a base end 86. The blade assembly 7 is shown in FIG. 2 in a blade assembly open configuration 31. In this configuration a blade insert 81, which contains the rotary blade 41 (shown in FIG. 2 with a blade cover 44 on in the blade guarded cover position 83) and the blade retaining structure 42 which secures the rotary blade 41 to the blade assembly 7, may be removed, as shown in FIG. 9, by engaging the blade insert tab 43. The blade insert 81 may also be installed in the blade assembly 7 while the blade assembly 7 is in the blade assembly open configuration 31. With the blade assembly 7 in the blade assembly open configuration 31, the blade cover 44 may also be removed, as shown in FIG. 10, to ready the fabric circle cutter 1 for a cutting operation, or reinstalled as shown in FIG. 2 to the blade guarded cover position 83 for the safe stowing of the fabric circle cutter 1.

Referring again to FIG. 1 and FIG. 2, the blade assembly 7 may be changed from the closed blade assembly configuration 29 shown in FIG. 1 to the open blade assembly configuration 31 shown in FIG. 2 by engaging the blade assembly release 21 and sliding it in the blade assembly release groove 23. As the blade assembly release 21 is slid in the blade assembly release groove 23, the release arm 35 is retracted from the release clip 33, thereby allowing the blade assembly 7 to be rotated from the blade assembly closed configuration 29 to the blade assembly open configuration 31 shown in FIG. 2. When the blade assembly 7 is returned to the blade assembly closed assembly configuration 29 as shown in FIG. 1, the blade assembly 7 is locked in the blade assembly closed configuration 29 with the release arm 35 engaged by the release clip 33. The release hinge 19 provides for the rotation of the release assembly 7 between the release assembly closed configuration 29 and the release assembly open configuration 31. Referring again to FIG. 1 with the blade assembly in the blade assembly closed configuration 29, the blade assembly tab 27 mates with the blade assembly slot 25 and prevents horizontal rotation of the blade assembly 7, thereby preventing radial movement of the rotary blade 41 during a circle cutting operation.

Figure 3:
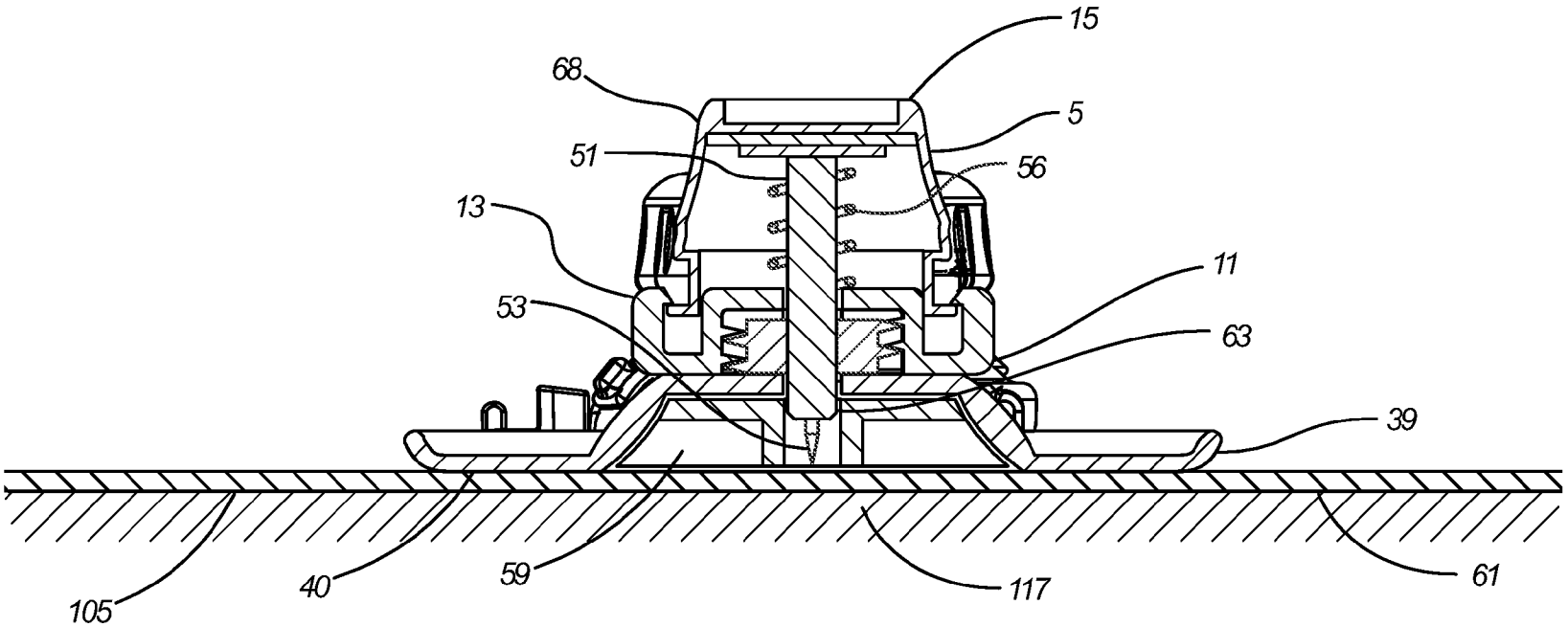
FIG. 3 is a vertical cross-section of a preferred embodiment of a pivot pin assembly of the present invention with the pivot pin assembly being in a pin up configuration.

Referring now to FIG. 3, a vertical cross section of a preferred embodiment of the pivot pin assembly 5 is shown with the pivot pin assembly 5 in the pin up configuration 68. With the pivot pin assembly 5 in the pin up configuration 68, the pivot pin 53 does not extend below the cutter base bottom surface 40 and thus does not engage the fabric layer 61. The pivot point slide anchor assembly 59 secures the pivot pin assembly 5 to the raised base section 11 and maintains the proper positioning of the pin rod 51 in the pivot point slide slot 9.

Figure 4:
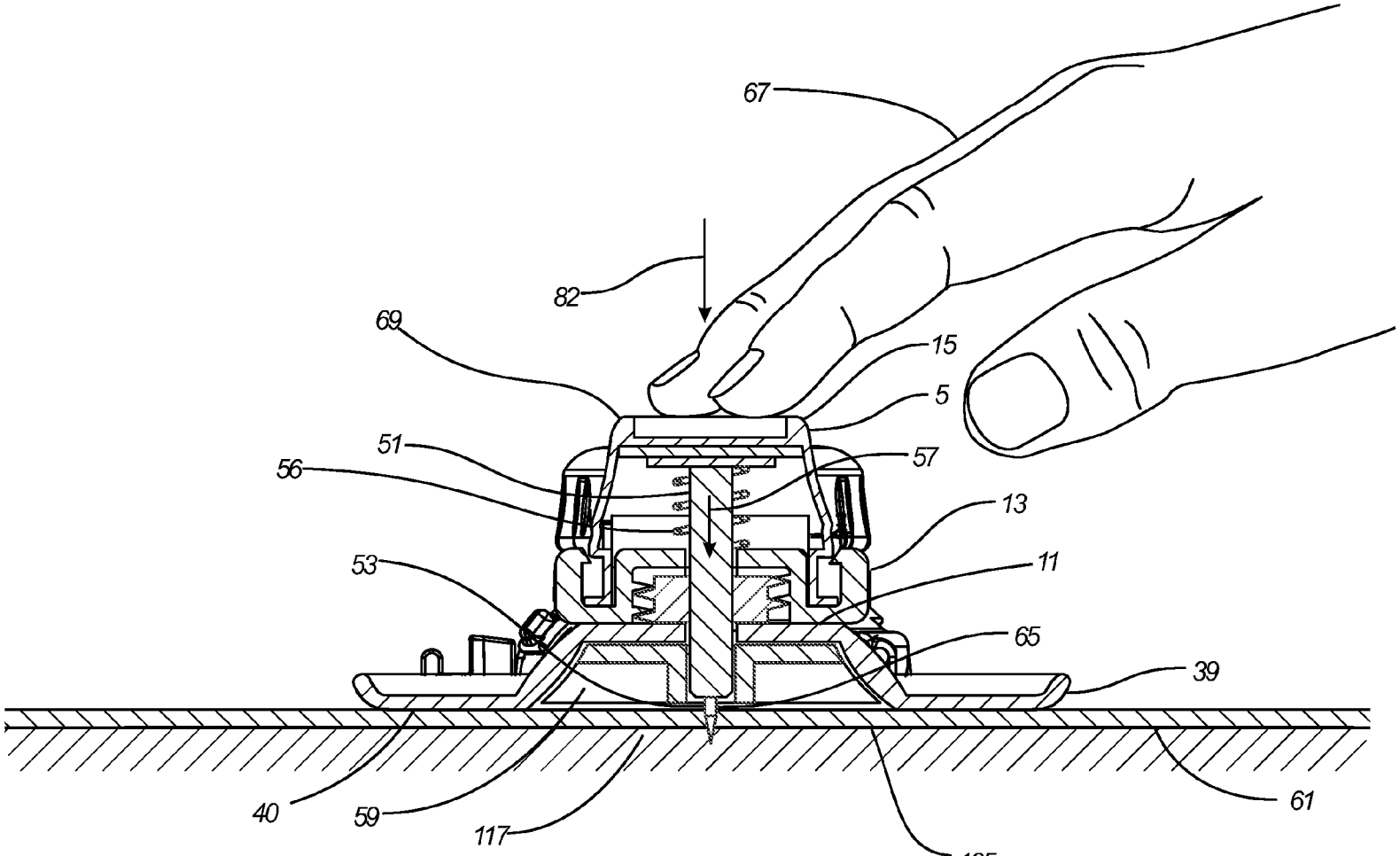
FIG. 4 is a vertical cross-section of a preferred embodiment of a pivot pin assembly of the present invention with the pivot pin assembly being in a pin down configuration.

For the embodiment shown in FIG. 3, a pivot rod spring 56 maintains the pivot pin assembly 5 in the pivot assembly pin up configuration 68, and the pivot rod 51 and the pivot pin 53 in the pivot pin up position 63. The pivot rod spring 56 further provides, as shown in FIG. 4, as a pivot assembly downward force 82 is exerted on the pivot pin assembly top 15 by a first hand 67 of the user, for the pivot pin assembly 5 to be lowered to the pivot assembly pin down configuration 69, and for the pivot rod 51 and the pivot pin 53 to be lowered to the pivot pin down position 65 as shown in FIG. 4, thereby causing the pivot pin 53 to engage the fabric layer 61. When the pivot assembly downward force 82 exerted by the first hand 67 of user is released, the pivot rod spring 56 causes the pivot pin assembly 5 to return to the pivot assembly pin up configuration 68 and the pivot rod 51 and the pivot pin 53 to return to the pivot pin up position 63.

In view of the disclosures of this specification and the drawings, other variations in the pivot pin assembly 5 will be known to persons of skill in the art, which will provide for the extension of the pivot pin 53 into the fabric 61 as the user applies a pivot assembly downward force 82 with her or his hand to the pivot assembly top 15 and for the retraction of the pivot pin 53 when the user ceases to apply a pivot assembly downward force 82 to the pivot assembly top 15.

If the fabric layer is being cut on a cutting surface 117 that is made of material that will allow penetration of the pivot pin into the cutting surface 117 below the support surface 105, preferred embodiments of the fabric circle cutter 1 may allow additional pivot pin assembly downward travel 57, thereby allowing the pivot pin 53 to penetrate through the support surface 105 into the cutting surface 117 as shown in FIG. 4. This may provide additional ease and stability for the user in completing a cut.

Figure 5:
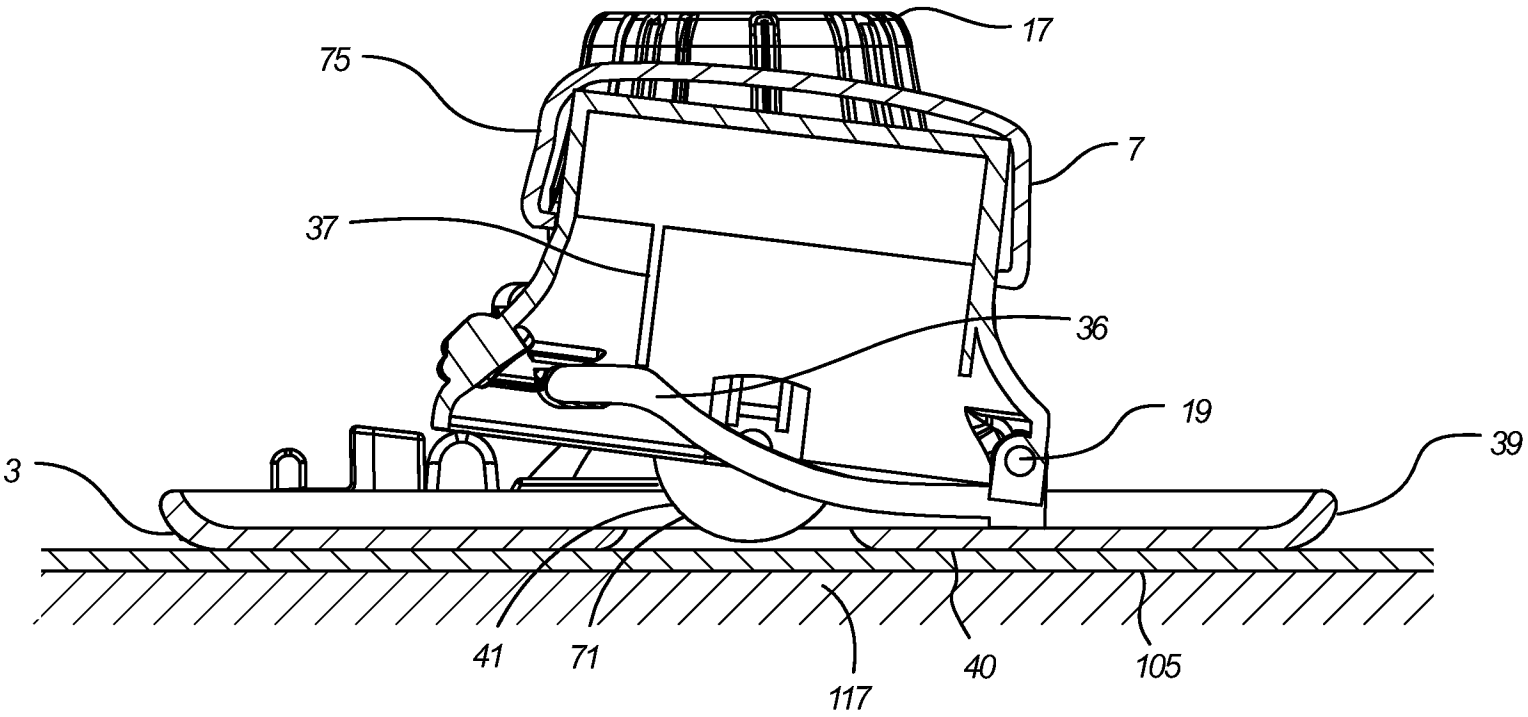
FIG. 5 is a vertical cross-section of a preferred embodiment of a blade assembly of the present invention with the blade assembly being in a blade up configuration.

Referring now to FIG. 5, a cross section of the preferred embodiment of the blade assembly 7 is shown in the blade assembly non-engaged configuration 75. In the blade assembly non-engaged configuration 75, the blade extension tab 37 is resting atop the blade spring arm 36. In this configuration, the blade spring arm 36 causes the rotary blade 41 to remain in the blade non-engaged position 71 above the cutter base bottom surface 40, and, therefore, in this position, the rotary blade 41 does not engage the fabric layer 61.

Figure 6:
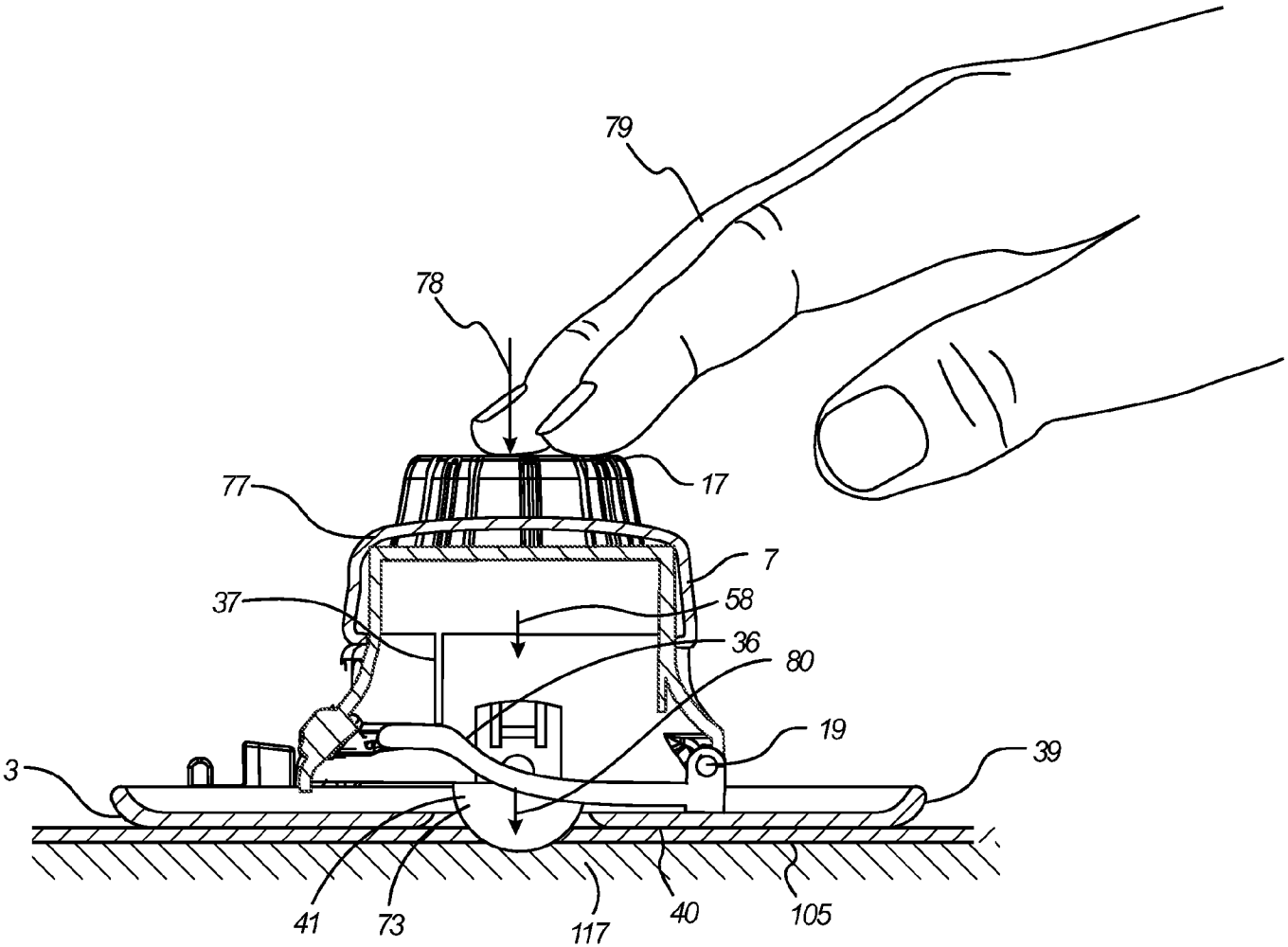
FIG. 6 is a vertical cross-section of a preferred embodiment of a blade assembly of the present invention with the blade assembly being in a blade down configuration.

Referring now to FIG. 6, a blade assembly downward force 78 applied by the second hand 79 of the user on the blade assembly top 17 of the blade assembly 7 causes the blade extension tab 37 to press down on the blade spring arm 36, and causes the blade assembly 7 to experience blade assembly downward movement 58 by rotating on the release hinge 19 from the blade up configuration 75 to the blade down configuration 77 as shown in FIG. 6. This causes the rotary blade 41 to go from a blade non-engaged position 71 to the blade engaged position 73 where it has engaged and penetrated through the fabric layer 61. Preferred embodiments of the blade assembly 7 will allow sufficient downward blade movement 80 to enable the rotary blade 41 to penetrate into the cutting surface 117, if the cutting surface 117 is made of material that will allow penetration of the rotary blade 41 through the support surface 105 into the cutting surface 117 during the cutting operation, as shown in FIG. 6.

In view of current materials technology, the inventor prefers the use of a transparent polycarbonate material for the cutter base 3 and other parts that experience significant static or dynamic loading, such as the blade spring arm 36. This material is strong and durable and withstands many cycles of engagement and release without permanent deformation or weakening. Parts that do not experience significant loading may be constructed from ABS.

In view of the disclosures of this specification and the drawings, other variations in the blade assembly 7 will be known to persons of skill in the art, which will provide for the lowering of the rotary blade 41 into the fabric 61, as the user applies a blade assembly downward force 78 with her or his hand to the blade assembly top 17, and for the retraction of the rotary blade 41 when the user ceases to apply a blade assembly downward force 78 to the blade assembly top 17.

The rotary blade 41 is now in position for the fabric circle cutter 1 to be operated to cut a circular pattern 101 in the fabric layer 61 as shown in FIG. 8. Referring also to FIG. 7, the pivot pin assembly 5 is in the pin down configuration 69 and the blade assembly 7 is in the blade down configuration 77. The pivot pin 53 is thus engaged in the fabric layer 61 and the rotary blade 41 is fully engaged and fully penetrated into the fabric layer 61, both the pivot pin 53 and the rotary blade 41 penetrating at least to the support surface 105 which may be a cutter protector surface on a table or other working area.

Referring again to FIG. 8, for a preferred method of using the fabric circle cutter 1 to cut a circular swatch 107 from the fabric layer 61, with the pivot pin assembly 5 in the pin down configuration 69 due to the pivot assembly downward force 82 exerted on the pivot assembly top 15 by the first hand 67 of the user, and the blade assembly 7 in the blade down configuration 77 due to the blade assembly downward force 78 exerted on the blade assembly top 17 by the second hand 79 of the user as shown in FIG. 7, the blade assembly 7, and thus the rotary blade 41, can be clockwise rotated 97 or counter-clockwise rotated 99 around the pivot axis 103 of the pivot pin 53, thereby making a circular cut 101 as shown in FIG. 8. The turned up cutter base edge 39 and the flat, smooth cutter base bottom surface 40 provide for the fabric 61 to be retained in an unwrinkled and slightly tensioned condition as the rotary blade 41 cuts the circular swatch 107 from the fabric layer 61, the circular swatch 107 having a radius equal to the cut radius 109 selected by the user.

Referring again to FIG. 8, for the preferred embodiment of the fabric circle cutter 1, the pivot point slide slot 9 has a slide slot centerline 91. Referring to FIG. 10, the rotary blade 41 has a blade axis of rotation 92. With the blade assembly 7 in the blade assembly closed configuration 29, the blade axis of rotation 92 may preferably be approximately aligned horizontally with and approximately parallel to the slide slot centerline 91, although the blade axis of rotation 92 may be displaced vertically from the slide slot centerline 91. With the blade axis of rotation 92 being approximately horizontally aligned with and approximately parallel to the slide slot centerline 91, the rotary blade will be approximately perpendicular to the support surface 105 and aligned with the cut perimeter 121 during the cutting operation.

Referring again to FIG. 9, for preferred embodiments of the fabric circle cutter 1, radius measurement scales 113 may be etched, painted or otherwise marked on one or both of the cutter base sides 111, which provides for direct and accurate measurement and setting of the cut radius 109 using only the fabric circle cutter 1 itself. The cutter base 3 may be constructed of transparent material, and the raised base section wall 115 may be convex on either or both sides, causing the raised base section wall 115 to provide magnification of the view of the user of the fabric 61 beneath the raised base section 11. This will aid the user to see and work with markings on the fabric 61 beneath the raised base section 11, and to observe whether there are wrinkles in the fabric between the first base edge 16 and the second base edge 18 of the cutter base 3.

Referring again to FIG. 2, a blade lock assembly 45 may be used to prevent unintended deployment of the rotary blade 41 and to enhance user safety. For the preferred embodiment of the blade lock assembly 45 shown, the user may exert a force by finger on the blade lock tab 49, causing the blade lock assembly 45 to slide in the blade lock slot 47 to a blade lock position where a pair of blade assembly blocks 46 will prevent the rotary blade 41 from being lowered to the blade down position 73 shown in FIG. 6. The blade lock assembly 45 may be returned to the blade unlock position shown in FIG. 1 and FIG. 2, through the exertion of a force by finger on the blade lock tab 49.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A fabric circle cutter for cutting a circular swatch of fabric from a larger piece of fabric, the fabric circle cutter comprising:

a cutter base having a raised base section, the raised base section having a pivot point slide slot with a slide slot centerline;

a pivot pin assembly slidably mounted on the raised base section and slidably mated to the pivot point slide slot, the pivot pin assembly having a pivot assembly top and a pivot pin, the pivot pin assembly having a capability for lowering the pivot pin from a pivot pin up position to a pivot pin down position in response to an application of a pivot assembly downward force on the pivot assembly top by a user, and the pivot pin assembly having a capability for retracting the pivot pin from the pivot pin down position to the pivot pin up position in response to a cessation by the user of the pivot assembly downward force; and a blade assembly mounted on top of the cutter base proximal to an end of the cutter base, the blade assembly having a blade assembly top, a blade spring arm, a release hinge, a blade assembly release, a blade assembly release groove, a release arm, a release clip and a rotary blade, the rotary blade being rotatably attached to the blade spring arm which is rotatably attached to the blade assembly by the release hinge, and having a blade axis of rotation, the blade axis of rotation being approximately horizontally aligned with and approximately parallel to the slide slot centerline, the blade assembly having a capability for lowering the rotary blade from a blade non-engaged position above the cutter base to a blade engaged position below the cutter base by a downward rotation of the blade spring arm on the release hinge in response to an application of a blade assembly downward force on the blade assembly top by the user, the blade spring arm maintaining the rotary blade in the blade non-engaged position above the cutter base in the absence of the blade assembly downward force, the blade assembly having a capability for retracting the rotary blade to the blade non-engaged position above the cutter base by an upward rotation of the blade spring arm on the release hinge in response to a cessation by the user of the blade assembly downward force, the blade assembly release being slidable in the blade assembly groove, the blade assembly release being connected to the release arm, and the blade assembly having a release capability for transitioning the blade assembly from a closed blade assembly configuration to an open blade assembly configuration by providing for the user to slide the blade assembly release in the blade assembly release groove wherein the release arm is retracted from the release clip providing for the user to rotate the blade assembly on the release hinge from the blade assembly closed configuration to the blade assembly open configuration, and the release capability providing for transitioning of the blade assembly back to the blade assembly closed configuration by providing for the user to rotate the blade assembly on the release hinge from the blade assembly open configuration to the blade assembly closed configuration wherein the release arm is engaged by the release clip securing the blade assembly in the blade assembly closed configuration.

2. The fabric circle cutter recited in claim 1 wherein the cutter base has a turned up edge and a flat bottom surface.

3. The fabric circle cutter recited in claim 1 further comprising one or more radius measurement scales on the cutter base.

4. A fabric circle cutter for cutting a circular swatch of fabric from a larger piece of fabric, the fabric circle cutter comprising:

a cutter base having a raised base section, a turned up edge, and a flat bottom surface, the raised base section having a pivot point slide slot with a slide slot centerline;

a pivot pin assembly slidably mounted on the raised base section and slidably mated to the pivot point slide slot, the pivot pin assembly having a pivot assembly top, a pivot rod, and a pivot pin, the pivot pin assembly having a capability for lowering the pivot pin from a pivot pin up position to a pivot pin down position in response to an application of a pivot assembly downward force on the pivot assembly top by a user, and the pivot pin assembly having a capability for retracting the pivot pin from the pivot pin down position to the pivot pin up position in response to a cessation by the user of the pivot assembly downward force, a pivot rod spring maintaining the pivot pin assembly in a pivot assembly pin up configuration, and the pivot rod and the pivot pin in the pivot pin up position, the pivot rod spring further providing, as the pivot assembly downward force is exerted on the pivot pin assembly top by the user, for the pivot pin assembly to be lowered to the pivot assembly pin down configuration and for the pivot rod and the pivot pin to be lowered to the pivot pin down position, and, upon the cessation of the pivot assembly downward force exerted by the user, the pivot rod spring providing for the pivot pin assembly to return to the pivot assembly pin up configuration and the pivot rod and the pivot pin to return to the pivot pin up position; and a blade assembly mounted on top of the cutter base proximal to an end of the cutter base, the blade assembly having a blade assembly top, a blade spring arm, a release hinge, a blade assembly release, a blade assembly release groove, a release arm, a release clip and a rotary blade, the rotary blade being rotatably attached to the blade spring arm which is rotatably attached to the blade assembly by the release hinge, and having a blade axis of rotation, the blade axis of rotation being approximately horizontally aligned with and approximately parallel to the slide slot centerline, the blade assembly having a capability for lowering the rotary blade from a blade non-engaged position above the cutter base to a blade engaged position below the cutter base by a downward rotation of the blade spring arm on the release hinge in response to an application of a blade assembly downward force on the blade assembly top by the user, the blade spring arm maintaining the rotary blade in the blade non-engaged position above the cutter base in the absence of the blade assembly downward force, and the blade assembly having a capability for retracting the rotary blade to the blade non-engaged position above the cutter base by an upward rotation of the blade spring arm on the release hinge in response to a cessation by the user of the blade assembly downward force, the blade assembly release being slidable in the blade assembly groove, the blade assembly release being connected to the release arm, and the blade assembly having a release capability for transitioning the blade assembly from a closed blade assembly configuration to an open blade assembly configuration by providing for the user to slide the blade assembly release in the blade assembly release groove wherein the release arm is retracted from the release clip providing for the user to rotate the blade assembly on the release hinge from the blade assembly closed configuration to the blade assembly open configuration, and the release capability providing for transitioning of the blade assembly back to the blade assembly closed configuration by providing for the user to rotate the blade assembly on the release hinge from the blade assembly open configuration to the blade assembly closed configuration wherein the release arm is engaged by the release clip securing the blade assembly in the blade assembly closed configuration.

5. The fabric circle cutter recited in claim 4 further comprising one or more radius measurement scales on the cutter base.

6. The fabric circle cutter recited in claim 1 wherein the blade assembly has a blade assembly tab and a blade assembly slot, the blade assembly tab mating with the blade assembly slot in the blade assembly closed configuration and preventing horizontal rotation of the blade assembly and radial movement of the rotary blade during a circle cutting operation.

7. The fabric circle cutter recited in claim 4 wherein the blade assembly has a blade assembly tab and a blade assembly slot, the blade assembly tab mating with the blade assembly slot in the blade assembly closed configuration and preventing horizontal rotation of the blade assembly and radial movement of the rotary blade during a circle cutting operation.

* * * * *